US008443729B2

(12) United States Patent
Mittelstaedt

(10) Patent No.: US 8,443,729 B2
(45) Date of Patent: May 21, 2013

(54) CARTRIDGE FOR A FIREARM

(75) Inventor: Mitchell T. Mittelstaedt, Grand Island, NE (US)

(73) Assignee: Hornady Manufacturing Company, Grand Island, NE (US)

( * ) Notice: Subject to any disclaimer, the term of this patent is extended or adjusted under 35 U.S.C. 154(b) by 1405 days.

(21) Appl. No.: 11/710,463

(22) Filed: Feb. 22, 2007

(65) Prior Publication Data

US 2008/0202372 A1 Aug. 28, 2008

(51) Int. Cl.
*F42B 5/02* (2006.01)

(52) U.S. Cl.
USPC ..... 102/464; 102/430

(58) Field of Classification Search
USPC ..... 102/464, 467, 469, 470, 439, 468, 102/430
See application file for complete search history.

(56) References Cited

U.S. PATENT DOCUMENTS 6,354,221 B1 * 3/2002 Jamison ..... 102/430
6,532,876 B1 * 3/2003 Ramirez et al. ..... 102/430

OTHER PUBLICATIONS

"The RCBS Load Cartridge Designer Utility"; published on the Internet Apr. 31, 2001; http//www.qmdr.com/rcbs/rcbstext9.html, p. 14.*

* cited by examiner

*Primary Examiner* — James Bergin
(74) *Attorney, Agent, or Firm* — Bennet K. Langlotz; Langlotz Patent & Trademark Works, Inc.

(57) ABSTRACT

The present invention overcomes the limitations of the prior art by providing a centerfire rifle cartridge with a case having a head having a rim, a body extending from the head to a tapered shoulder, and a neck extending from the shoulder and defining a mouth receiving a bullet. The body has a straight external surface free of a protruding belt, and has a maximum diameter sized to closely fit for operation within a standard action of magnum width. The cartridge has an overall length sized to closely fit for operation within a standard action such as a short action or a long action.

20 Claims, 2 Drawing Sheets

CARTRIDGE FOR A FIREARM

FIELD OF THE INVENTION

This invention relates to the firearm ammunition, and more particularly to centerfire cartridges for rifles.

BACKGROUND AND SUMMARY OF THE INVENTION

Rifle cartridges for firearms are available in a wide range of shapes and sizes for different applications. However, the variations are not infinite, and there are important constraints on cartridge dimensions. A typical rifle cartridge has a bottleneck shape with a slightly tapered nearly cylindrical body extending from a base or head to a much more tapered conical shoulder that transitions to a nearly cylindrical neck that receives a bullet. The case head typically has a groove near the head to provide a rim for a rifle extractor to engage, enabling removal of the case from a rifle chamber after firing.

Some cartridges are "belted", in that they have a larger diameter band near the head, with a forward facing step. The main body portion has a slightly smaller diameter than the belted portion. When a belted cartridge is chambered, the belt step provides a stop that establishes the axial position of the cartridge in the chamber. In contrast, an standard non-belted cartridge limits its insertion depth by the shoulder engaging an internal shoulder in the chamber.

While cartridges may exist in any theoretical dimension, there are a number of reason why cartridges have been limited in their dimensions.

First, the characteristics of gun powder and structural limitations on rifle actions (which define the chamber) make many extreme dimensional ratios impractical or unsafe.

Second, cartridges are generally made in "families," which each member of the family produced from a common source or "parent" cartridge case. This can be as simple as a standard case that is necked down for a smaller bullet caliber (or expanded for a larger caliber). Parent cases may be shortened as well. Nonetheless, essentially all the modification of the parent cartridge occurs at the end of the cartridge near the mouth. There is very little that can be done after a case is made to change the dimensions near the case head in any useful manner, aside from minor (but impractical in large scale production) machining operations such as to trim the rim to a smaller rebated diameter or to machine turn off a belt.

While it is easy to conceive of cartridges outside of established families (those with established case head dimensions) there is a powerful economic barrier to creating new cartridges outside of these families, due to the large tooling cost for a new cartridge. This is one reasons why belted cartridges have persisted, even though the original reason for the belt (for historic cartridges without prominent shoulders to establish depth) does not apply to many or most modern belted cartridges.

A third limitation on cartridge dimensions is the dimensions of the actions of the rifles that are to receive them. Again, rifle actions may be conceived in any length or width, but it is impractical for rifle manufacturers to generate a new size for a new cartridge that may be proposed (and there is a powerful disincentive to develop a cartridge for which there are no rifles capable of shooting it—or if the only rifles that do receive it are needlessly heavy, large or expensive.) Thus rifle actions (in the field of bolt action rifles for this discussion) are generally produced in just a few limited size categories. Even competing rifle makers use the same standard sizes, because they are producing rifles for the same market of standard ammunition.

A bolt-rifle's action will have a main elongated lower opening rearward of the chamber through which a cartridge is received (this opening may be on the side or top for single shot rifles). The opening has a length that limits the cartridge overall length (COL) that can be received, and this opening length essentially defines the length of the action. While it is disadvantageous to employ an action that is significantly longer than needed for a given cartridge due to weight, cost, size, and strength reasons, slight excess length is tolerated. Thus, there are only a limited number of action (opening) lengths produced.

A "short action" closely accepts a cartridge with a maximum COL of 2.84 inch. This is sized to optimally receive the 308 Winchester cartridge, for instance.

A "long action" closely accepts a cartridge with a maximum COL of 3.34 inch. This is sized to optimally receive the 30-06 Springfield cartridge, for instance.

A "magnum action" closely accepts a cartridge with a maximum COL of 3.60 inch. This is sized to optimally receive the 375H&H Magnum cartridge, for instance.

The width of the action opening limits the diameter of the accepted cartridge. Typical actions are provided in one of three standard widths, to provide standardization for the reasons noted above.

A standard width action admits a cartridge with a maximum diameter of 0.473 inch. This is sized to closely accommodate the 308 Winchester, and the 30-06 Springfield cartridges, for instance.

A magnum width action admits a cartridge with a maximum diameter of 0.532 inch. This is sized to closely accommodate the following example cartridges:

- 350 Remington Magnum (a short-action belted cartridge)
- 6.5 mm Remington Magnum (a short-action belted cartridge)
- 300 Winchester Magnum (a long-action belted cartridge)
- 7 mm Remington Magnum (a long-action belted cartridge)
- 375H&H Magnum (a magnum-length-action belted cartridge)
- Lazzeroni 6.53 Scramjet (a magnum-length-action unbelted cartridge.)

A super magnum width action admits a cartridge with a maximum diameter of 0.580 inch. This is sized to closely accommodate the 378 and 460 Weatherby (super magnum length belted cartridges), for instance. The 300 Winchester Short Magnum (WSM) also requires an action larger than a magnum-width action (whether a special width or a super magnum width action) because its 0.555 inch base diameter does not fit in a magnum-width action. The WSM has a reduced or rebated rim with such diameter to be accommodated by standard magnum bolts, with the stability and feeding disadvantages associated with rebated rims.)

The above standard sizes creates a 3-by-3 "grid" with nine bins into which the main category of centerfire bottlenecked rifle cartridges are necessarily categorized. In certain bins, the cartridges previously developed to fit the dimensional constraints have limitations on the power available to shooters.

The present invention overcomes the limitations of the prior art by providing a centerfire rifle cartridge with a case having a head having a rim, a body extending from the head to a tapered shoulder, and a neck extending from the shoulder and defining a mouth receiving a bullet. The body has a straight external surface free of a protruding belt, and has a maximum diameter sized to closely fit for operation within a standard action of magnum width. The cartridge has an overall length sized to closely fit for operation within a standard action such as a short action or a long action.

DETAILED DESCRIPTION OF A PREFERRED EMBODIMENT

Figure 1:
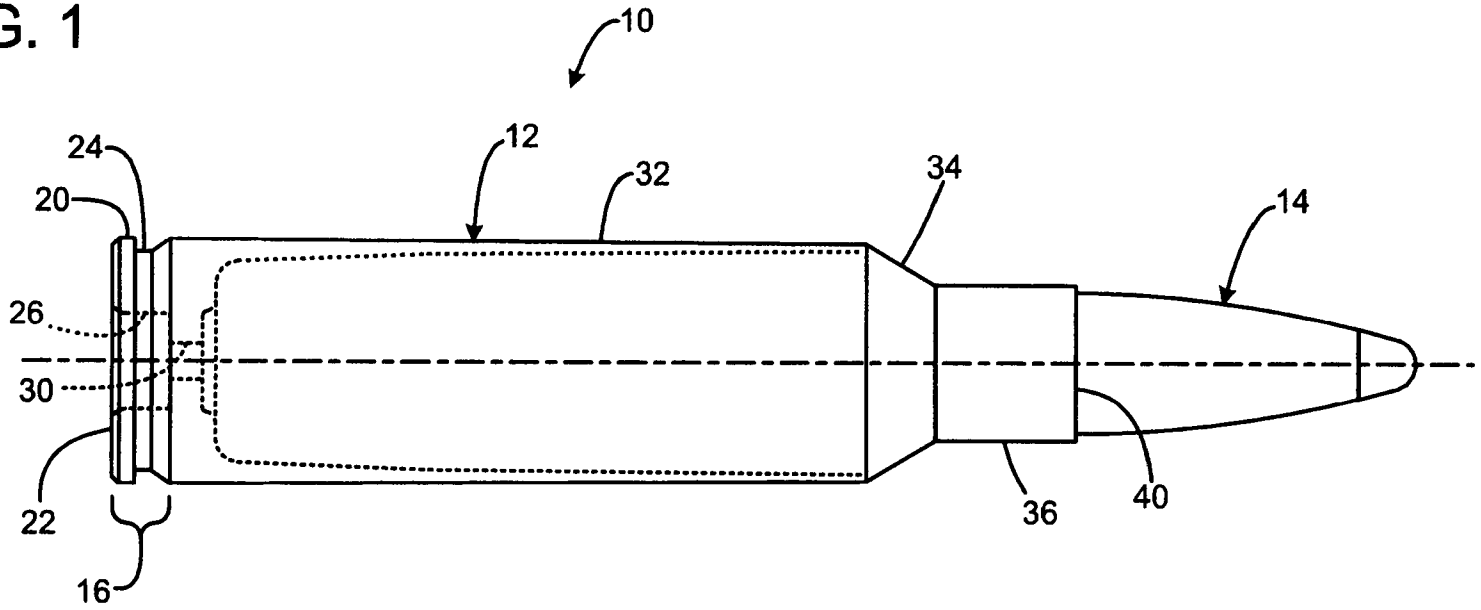
FIG. 1 is a side view of a rifle cartridge according to a preferred embodiment of the invention.

FIG. 1 shows a rifle cartridge 10 designated "300 Ruger" having a brass case 12 containing a charge of powder (not shown), with a bullet 14 received in a forward end of the case.

The case has a head 16 including a rim 20 nearest the rear head face 22 of the head, and an extraction groove 24 forward of the rim. A primer pocket 26 is centrally defined in the face 22, and communicates via a flash hole 30 with the interior of the case in which the powder charge is contained. The case has a main body portion 32 that is a gently tapered, nearly cylindrical conical portion extending forward from the groove 24. A more steeply tapered shoulder 34 transitions from the forward end of the body to a smaller essentially cylindrical neck 36, which has a forward end defining the mouth 40 that receives the bullet 14.

In the illustrated embodiment, the case head rim has a diameter of 0.532 (all dimensions in inches)+0.000/−0.010.

The groove has a diameter of 0.475+0.000/−0.020.

The body has a diameter of 0.532+0.000/−0.008 at a position 0.200 forward of the case head face 22. This is the same as the rim diameter, except for a slightly tighter tolerance for undersizing.

The body has a diameter of 0.5167+0.000/−0.008 at a position 1.500 forward of the case head face, and 0.515+0.000/−0.008 at the junction with the shoulder.

The shoulder is tapered at a 30 degree angle to the axis of the case.

The shoulder has a diameter of 0.420 at a position 1.7257+0.000/−0.007 forward of the case head face.

The neck has a diameter of 0.340+0.000/−0.008, and the bullet has a diameter of 0.3090+0.000/−0.003.

The rim has a thickness of 0.050+0.000/−0.011, and the inner cylindrical portion of the groove meeting the diameter dimensions has a length along the body axis of 0.037+0.010/−0.000.

The body-to-shoulder junction is 1.643 from the case head face 22, and the shoulder-to-neck junction is at 1.795 from the case head face 22.

The case length from the case head face to the mouth is 2.100+0.000/−0.020.

The cartridge overall length (COL) to the bullet tip is 2.840+0.000/−0.125.

The rim having the same diameter as the rear of the case body, the case is neither rimmed nor rebated, and the case is described as "rimless". Because the rim is of a standard diameter, a rifle chambered for the cartridge may employ a standard bolt without requiring a custom component or increased inventory. And with the body having a straight sidewall outer surface (slightly conically tapered to facilitate feeding and extraction) the case is unbelted.

Moreover, unlike low-volume cases produced at great expense, the straight body is not produced by removing the belt from a larger standard belted cartridge, but is produced by a standard deep-drawing manufacturing process that forms the straight wall without a belt. This provides a consistent smooth surface finish that facilitates feeding and extraction, avoiding circumferential machining marks that increase friction, or require further undesirable post-processing.

The cartridge 10 is sized with a width that closely fits a magnum width action opening, and a COL to fit a short action opening. The straight unbelted case allows a larger internal volume that would be provided with a belted cartridge, which would have smaller body diameter that the preferred embodiment due to the belt diameter limiting the cartridge size. This provides a maximum power cartridge within the dimensional envelope limitations of the standard "bin" for the selected action length and width.

The cartridge has a nominal length-to-diameter ratio of 5.34, which is optimized for the selected action dimensions. Allowing for the length and diameter tolerances, the ratio may range between 5.10 and 5.42. Expanded tolerances may put this range between 5.00 and 5.50.

The preferred embodiment provides a straight-bodied (unbelted) cartridge with a body diameter and COL that closely fit within a magnum width, short length action.

The preferred embodiment further provides a straight-bodied unbelted cartridge with a case produced from conventional high production techniques not requiring post-machining to remove a belt, with a body diameter that closely fits within a magnum width action.

Alternative Embodiment

Figure 2:
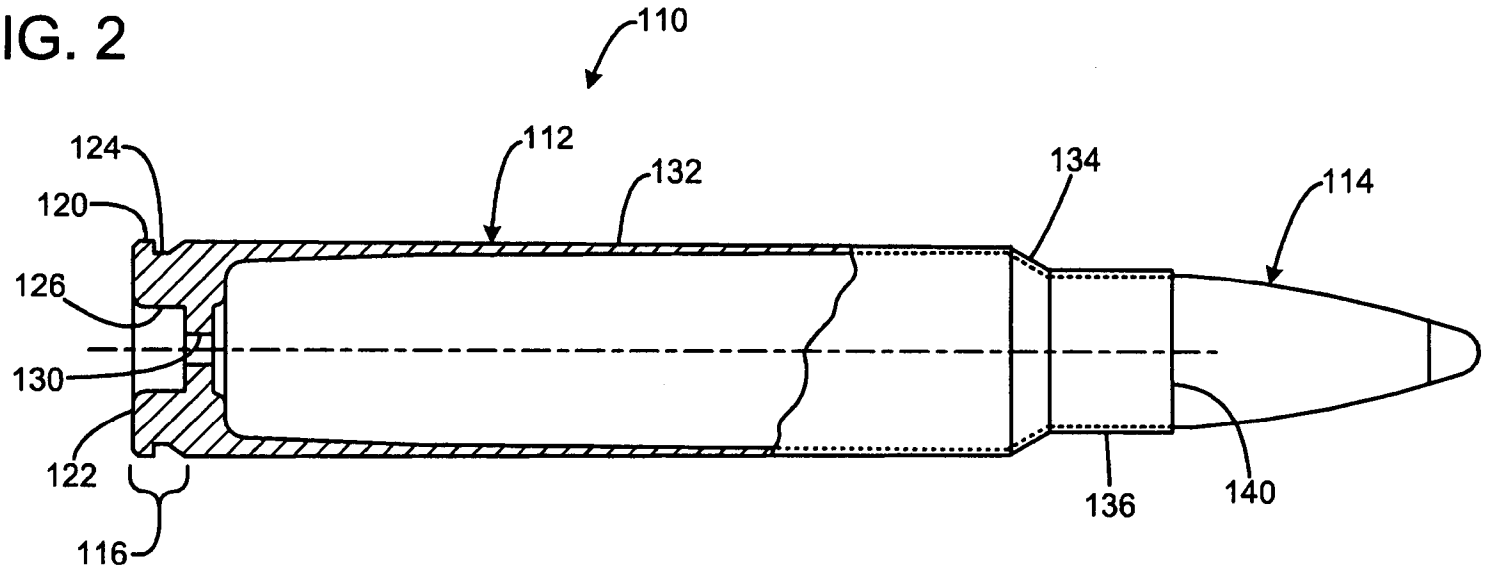
FIG. 2 is a side view of a rifle cartridge according to an alternative embodiment of the invention.

FIG. 2 shows an alternative embodiment, rifle cartridge 110 designated "375 Ruger" having a brass case 112 containing a charge of powder (not shown), with a bullet 114 received in a forward end of the case. The cartridge has many of the same dimensions as cartridge 10, except as noted below The case has a head 116 including a rim 120 nearest the rear head face 122 of the head, and an extraction groove 124 forward of the rim. A primer pocket 126 is centrally defined in the face 122, and communicates via a flash hole 130 with the interior of the case in which the powder charge is contained. The case has a main body portion 132 that is a gently tapered, nearly cylindrical conical portion extending forward from the groove 124. A more steeply tapered shoulder 134 transitions from the forward end of the body to a smaller essentially cylindrical neck 136, which has a forward end defining the mouth 40 that receives the bullet 114.

In the illustrated embodiment, the case head rim has a diameter of 0.532 (all dimensions in inches)+0.000/−0.010.

The groove has a diameter of 0.475+0.000/−0.020.

The body has a diameter at a position 0.200 forward of the case head face 22 of 0.532+0.000/−0.008, which is the same as the rim, except for a slightly tighter tolerance for undersizing.

The body has a diameter of 0.5170+0.000/−0.008 at a position 1.950 forward of the case head face, and 0.515+0.000/−0.008 at the junction with the shoulder.

The shoulder is tapered at a 30 degree angle to the axis of the case.

The shoulder is a diameter of 0.465 at a position 2.2230+0.000/−0.007 forward of the case head face.

The neck has a diameter of 0.405+0.000/−0.008, and the bullet has a diameter of 0.376+0.000/−0.003.

The rim has a thickness of 0.050+0.000/−0.011, and the inner cylindrical portion of the groove meeting the diameter dimensions has a length along the body axis of 0.037+0.010/−0.000.

The body-to-shoulder junction is 2.1797 from the case head face 22, and the shoulder-to-neck junction is at 2.2750 from the case head face 22.

The case length from the case head face to the mouth is 2.580+0.000/−0.020.

The cartridge overall length (COL) to the bullet tip is 3.340+0.000/−0.060.

As with the preferred embodiment, the rim having the same diameter as the rear of the case body, the case is neither rimmed nor rebated. Because the rim is of a standard diameter, a rifle chambered for the cartridge may employ a standard bolt without requiring a custom component or increased inventory. And with the body having a straight sidewall outer surface (slightly tapered to facilitate feeding and extraction) the case is unbelted.

Moreover, unlike low-volume cases produced at great expense, the straight body is not produced by removing the belt from a larger standard belted cartridge, but is produced by a standard deep-drawing manufacturing process that forms the straight wall without a belt.

The cartridge 110 is sized with a width that fits a magnum width action opening, and a COL to fit a long action opening. The straight unbelted case allows a larger internal volume that would be provided with a belted cartridge, which would have smaller body diameter that the preferred embodiment due to the belt diameter limiting the cartridge size. This provides a maximum power cartridge within the dimensional envelope limitations of the standard "bin" for the selected action length and width.

The cartridge has a nominal length-to-diameter ratio of 6.28, which is optimized for the selected action dimensions. Allowing for the length and diameter tolerances, the ratio may range between 6.17 and 6.37.

The preferred embodiment provides a straight-bodied (unbelted) cartridge with a body diameter and COL that closely fit within a magnum width, long length action.

The preferred embodiment further provides a straight-bodied unbelted cartridge with a case produced from conventional high production techniques not requiring post-machining to remove a belt, with a body diameter that closely fits within a magnum width action.

A further alternative embodiment of the above cartridge may be provided with a .416 caliber bullet. It has all of the same major dimensions (it being produced from the same parent case) to fit in the same action. However, there are differences at the shoulder and neck to accommodate the larger bullet. In other embodiments, cartridges that maximize the available space provided by each category of standard action may be provided in all common calibers. Short action calibers may include: .257, .264, .277, .284, .308, .338. Long action calibers may include: .277, .284, .308, .323, .338, .358, .366, .375, .416.

While the above is discussed in terms of preferred and alternative embodiments, the invention is not intended to be so limited.

The invention claimed is:

1. A centerfire rifle cartridge comprising:

a case having a head having a rim, a body extending from the head to a tapered shoulder, a neck extending from the shoulder and defining a mouth receiving a bullet;

the body having a straight external surface free of a protruding belt;

the body having a maximum diameter sized to closely fit for operation within a standard action of magnum width;

the cartridge having an overall length sized to closely fit for operation within a standard action selected from the group of standard actions including short actions;

wherein the body has a maximum diameter of between 0.524 and 0.532 inch; and wherein the cartridge has an overall length of between 2.715 and 2.840 inch.

2. The cartridge of claim 1 wherein the cartridge has an overall length sized to closely fit for operation within a standard short action.

3. The cartridge of claim 2 wherein the case has an overall length of between 2.080 and 2.100 inch.

4. The cartridge of claim 2 wherein the shoulder has a diameter of 0.420 at a position between 1.719 and 1.726 inch from an end face of the head.

5. The cartridge of claim 2 wherein the bullet has a maximum diameter of between 0.306 and 0.309 inch.

6. The cartridge of claim 2 wherein the body has a diameter of about 0.517 at a position 1.500 inch from an end face of the head.

7. The cartridge of claim 2 wherein the cartridge has a ratio of overall length to body diameter at a location proximate to the head of less than or equal to 5.42.

8. The cartridge of claim 2 wherein the cartridge has a ratio of overall length to body diameter at a location proximate to the head of greater than or equal to 5.10.

9. The cartridge of claim 1 wherein the entire body has a consistent surface finish.

10. The cartridge of claim 1 wherein the rim has substantially the same diameter as a rear portion of the body proximate to the rim.

11. A centerfire rifle cartridge comprising:

a case having a head having a rim, a body extending from the head to a tapered shoulder, a neck extending from the shoulder and defining a mouth receiving a bullet;

the body having a straight external surface free of a protruding belt;

the body having a maximum diameter of greater than or equal to 0.524 inch; and the cartridge having an overall length of less than or equal to 2.84 inch.

12. The cartridge of claim 11 wherein the cartridge has an overall length sized to closely fit for operation within a standard short action.

13. The cartridge of claim 11 wherein the case has an overall length of between 2.080 and 2.100 inch.

14. The cartridge of claim 11 wherein the shoulder has a diameter of 0.420 at a position between 1.719 and 1.726 inch from an end face of the head.

15. The cartridge of claim 11 wherein the bullet has a maximum diameter of between 0.306 and 0.309 inch.

16. The cartridge of claim 11 wherein the body has a diameter of about 0.517 at a position 1.500 inch from an end face of the head.

17. The cartridge of claim 11 wherein the cartridge has a ratio of overall length to body diameter at a location proximate to the head of less than or equal to 5.42.

18. The cartridge of claim 11 wherein the cartridge has a ratio of overall length to body diameter at a location proximate to the bead of greater than or equal to 5.10.

19. The cartridge of claim 11 wherein the entire body has a consistent surface finish.

20. The cartridge of claim 11 wherein the rim has substantially the same diameter as a rear portion of the body proximate to the rim.

* * * * *